US010409181B2

(12) United States Patent
Ozawa

(10) Patent No.: US 10,409,181 B2
(45) Date of Patent: Sep. 10, 2019

(54) MASTER BATCH FOR TONERS, METHOD FOR PRODUCING SAME, TONER AND METHOD FOR PRODUCING TONER

(71) Applicant: Mitsubishi Chemical Corporation, Chiyoda-ku (JP)

(72) Inventor: Tadahiro Ozawa, Tokyo (JP)

(73) Assignee: Mitsubishi Chemical Corporation, Chiyodu-ku (JP)

( * ) Notice: Subject to any disclaimer, the term of this patent is extended or adjusted under 35 U.S.C. 154(b) by 0 days.

(21) Appl. No.: 15/911,272

(22) Filed: Mar. 5, 2018

(65) Prior Publication Data

US 2018/0196365 A1 Jul. 12, 2018

Related U.S. Application Data

(63) Continuation of application No. PCT/JP2016/076294, filed on Sep. 7, 2016.

(30) Foreign Application Priority Data

Sep. 7, 2015 (JP) ..... 2015-175726

(51) Int. Cl.
*G03G 9/08* (2006.01)
*G03G 9/087* (2006.01)

(52) U.S. Cl.
CPC ..... *G03G 9/081* (2013.01); *G03G 9/087* (2013.01); *G03G 9/0821* (2013.01); *G03G 9/08726* (2013.01); *G03G 9/08728* (2013.01); *G03G 9/08755* (2013.01); *G03G 9/08791* (2013.01); *G03G 9/08797* (2013.01)

(58) Field of Classification Search
CPC ..... G03G 9/08755; G03G 9/08797
USPC ..... 430/109.4, 108.4
See application file for complete search history.

(56) References Cited

U.S. PATENT DOCUMENTS 5,342,722 A * 8/1994 Ito ..... G03G 9/08706 430/109.2
5,409,989 A * 4/1995 Ito ..... G03G 9/087 430/109.3
7,569,320 B2 * 8/2009 Nakanishi ..... C08G 63/127 430/109.4

FOREIGN PATENT DOCUMENTS

| | | |
|---|---|---|
| JP | 11-305483 | 11/1999 |
| JP | 2002-296839 | 10/2002 |
| JP | 2004-069872 | 3/2004 |

OTHER PUBLICATIONS

International Search Report dated Oct. 11, 2016 in PCT/JP2016/076294 filed Sep. 7, 2016 (with English Translation).
Written Opinion dated Oct. 11, 2016 in PCT/JP2016/076294 filed Sep. 7, 2016.

* cited by examiner

*Primary Examiner* — Mark A Chapman
(74) *Attorney, Agent, or Firm* — Oblon, McClelland, Maier & Neustadt, L.L.P.

(57) ABSTRACT

Disclosed herein is a master batch for toners, said master batch containing an acrylic polymer (A) and a polyester resin (B1) in a specific mass ratio. A toner disclosed herein contains the master batch and a polyester resin (B2), and has a content of the acrylic polymer (A) of 5% by mass or less. Methods for producing a master batch for toners are also disclosed herein and include a step of mixing an acrylic polymer (A) and a polyester resin (B1) in a specific mass ratio. Methods for producing a toner are also disclosed herein and include a step of mixing the master batch and a polyester resin (B2) so that a content of the acrylic polymer (A) is at a specific amount.

17 Claims, No Drawings

MASTER BATCH FOR TONERS, METHOD FOR PRODUCING SAME, TONER AND METHOD FOR PRODUCING TONER

The present application is a continuation application of International Application No. PCT/JP2016/076294, filed on Sep. 7, 2016, which claims priority to Japanese Patent Application No. 2015-175726, filed on Sep. 7, 2015, the entire contents of which are incorporated herein by reference.

TECHNICAL FIELD

The present invention relates to a master batch for toners, a method for producing the master batch, a toner, and a method for producing the toner.

BACKGROUND ART

With respect to demands for increasing speed, decreasing size, saving energy, and the like in printers in recent years, a decrease in temperature of a fixing unit of a heat roller type has been advanced. For this reason, low-temperature fixability is required in toners. Further, in order to improve fixing failure according to an increase in temperature of the fixing unit during continuous printing, a demand for hot offset resistance and a balance between material dispersibility (particularly, dispersibility of a release agent) with respect to oil-less fixing and hot offset resistance are also required in toners as well as low-temperature fixability.

Binder resins for toners have a large influence to toner performances as described above. As the binder resins for toners, for example, polystyrene resins, polyester resins, epoxy resins, polyamide resins, and the like are known.

The low-temperature fixability of the toner is improved, for example, by blending a release agent such as a wax with the toner.

The hot offset resistance is improved, for example, by increasing high-temperature elasticity of the toner.

For example, Patent Literature 1 discloses a toner that is obtained by dissolving or dispersing, in an organic solvent, a master batch in which a colorant is dispersed in a binder resin for toners such as a polyester resin, a resin identical to or different from the binder resin for toners, and a release agent such as a wax, subjecting the resultant product to emulsification dispersion in an aqueous medium, and then coagulating the emulsion.

CITATION LIST

Patent Literature

Patent Literature 1: JP 2002-296839 A

SUMMARY OF THE INVENTION

Problem to be Solved by the Invention

However, in the toner of the related art, variation in toner performance may occur in some cases. The cause for this is considered that the production stability of the toner is poor. For this reason, the dispersibility of the release agent in the toner may deteriorate or high-temperature elasticity may deteriorate in some cases.

The invention has been made in view of the above-described circumstances and an object thereof is to provide a method for producing a toner by which a toner with less variation in toner performance can be stably produced, a master batch for toners and a method for producing the same, and a toner with less variation in toner performance.

Means for Solving Problem

The invention has the following aspects.

[1] A master batch for toners, containing an acrylic polymer (A) and a polyester resin (B1), in which a mass ratio represented by the polyester resin (B1)/the acrylic polymer (A) is 2.5 or more.

[2] The master batch for toners described in [1], in which the acrylic polymer (A) is a polymer having two or more kinds of units selected from the group consisting of a methyl methacrylate unit, a n-butyl methacrylate unit, a n-butyl acrylate unit, and an isobutyl methacrylate unit.

[3] The master batch for toners described in [1], in which the acrylic polymer (A) is a polymer having a glycidyl (meth) acrylate unit.

[4] A toner containing the master batch for toners described in [1] and a polyester resin (B2), in which a content of the acrylic polymer (A) with respect to the total mass of the master batch for toners and the polyester resin (B2) is 5% by mass or less.

[5] The toner described in [4], in which the entire polyester resin (B) contained in the toner is a reaction product of an acid component and an alcohol component, and a proportion of a bisphenol derivative with respect to 100 parts by mole of the acid component is 60 parts by mole or less.

[6] The toner described in [4] or [5], in which a storage elastic modulus (G') at 200° C. is 200 to 10,000 Pa.

[7] The toner described in any one of [4] or [6], in which the acrylic polymer (A) is a polymer having two or more kinds of units selected from the group consisting of a methyl methacrylate unit, a n-butyl methacrylate unit, a n-butyl acrylate unit, and an isobutyl methacrylate unit.

[8] The toner described in any one of [4] or [6], in which the acrylic polymer (A) is a polymer having a glycidyl (meth) acrylate unit.

[9] A method for producing a master batch for toners, The method including a step of mixing an acrylic polymer (A) and a polyester resin (B1) such that a mass ratio represented by the polyester resin (B1)/the acrylic polymer (A) is 2.5 or more.

[10] A method for producing a toner, the method including a step of mixing a master batch for toners which contains an acrylic polymer (A) and a polyester resin (B1) and in which a mass ratio represented by the polyester resin (B1)/the acrylic polymer (A) is 2.5 or more and a polyester resin (B2) such that a content of the acrylic polymer (A) with respect to the total mass of the master batch for toners and the polyester resin (B2)is 5% by mass or less.

[11] A toner obtained by mixing a master batch for toners which contains an acrylic polymer (A) and a polyester resin (B1) and in which a mass ratio represented by the polyester resin (B1)/the acrylic polymer (A) is 2.5 or more and a polyester resin (B2) such that a content of the acrylic polymer (A) with respect to the total mass of the master batch for toners and the polyester resin (B2) is 5% by mass or less.

[12] The toner described in any one of [4] or [8], in which the toner contains two or more kinds of polyester resins each having a different softening temperature.

[13] The method for producing a master batch for toners described in [9], in which two or more kinds of polyester resins each having a different softening temperature are used.

[14] The method for producing a toner described in [10], in which two or more kinds of polyester resins each having a different softening temperature are used.

[15] The master batch for toners described in any one of [1] or [3], in which the polyester resin (B1) is a reaction product of an acid component and an alcohol component, and a proportion of a bisphenol derivative with respect to 100 parts by mole of the acid component is 60 parts by mole or less.

[16] The master batch for toners described in any one of [1] or [3], in which the polyester resin (B1) is a reaction product of an acid component and an alcohol component, a proportion of trivalent or higher carboxylic acid with respect to 100 parts by mole of the acid component is 25 parts by mole or less, and a proportion of trihydric or higher alcohol is 20 parts by mole or less.

[17] The toner described in any one of [4] or [8] and [12], in which the entire polyester resin (B) contained in the toner is a reaction product of an acid component and an alcohol component, a proportion of trivalent or higher carboxylic acid with respect to 100 parts by mole of the acid component is 25 parts by mole or less, and a proportion of trihydric or higher alcohol is 20 parts by mole or less.

EFFECT OF THE INVENTION

According to the method for producing a toner of the invention, a toner with less variation in toner performance can be stably produced.

By using the master batch for toners of the invention, a toner with less variation in toner performance can be stably produced.

The toner of the invention has less variation in toner performance.

MODE(S) FOR CARRYING OUT THE INVENTION

<Toner >

A toner of the invention contains a master batch for toners (C) and a polyester resin (B2). The master batch for toners (C) contains an acrylic polymer (A) and a polyester resin (B1). That is, the toner contains the acrylic polymer (A), the polyester resin (B1), and the polyester resin (B2). Hereinafter, the polyester resin (B1) and the polyester resin (B2) are also referred to collectively as a "polyester resin (B)."

<Acrylic Polymer (A)>

The acrylic polymer (A) (hereinafter, also referred to as "the component (A)") may be thermoplastic or thermosetting, but is preferably thermoplastic. That is, as the component (A), an acrylic thermoplastic resin is preferable.

As the component (A), those containing a monofunctional alkyl (meth)acrylate unit as a constituent component are preferable. The reason for this is that, since the monofunctional alkyl (meth)acrylate contains an ester group as a constituent unit, compatibility with the polyester resin (B) becomes favorable and the effect obtained by using the component (A) in combination with the polyester resin (B) is enhanced.

Herein, "(meth)acrylate" is a general term for acrylate and methacrylate.

Examples of a monofunctional (meth)acrylic acid alkyl ester include methyl (meth)acrylate, ethyl (meth)acrylate, n-butyl (meth)acrylate, isobutyl (meth)acrylate, propyl (meth)acrylate, 2-ethylhexyl (meth)acrylate, stearyl (meth) acrylate, phenyl (meth)acrylate, cyclohexyl (meth)acrylate, 2-hydroxycyclohexyl (meth)acrylate, 2-hydroxypropyl (meth)acrylate, dimethylaminoethyl (meth)acrylate, and glycidyl (meth)acrylate. These may be used alone or in combination of two or more kinds thereof.

The component (A) can be obtained by polymerizing 50 to 100 parts by mass of monofunctional (meth)acrylic acid alkyl ester and, as necessary, 50 parts by mass or less of other vinylic monomers which are copolymerizable with the monofunctional (meth)acrylic acid alkyl ester (100 parts by mass in total).

Examples of the other vinylic monomers include styrene-based monomers such as styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene, and 3,4-dicyclostyrene; carboxylic acid-containing vinyl monomers such as unsaturated dicarboxylic acid diesters (specifically, dimethyl maleate, diethyl maleate, dibutyl maleate, dimethyl fumarate, diethyl fumarate, dibutyl fumarate, and the like), unsaturated monocarboxylic acids (specifically, (meth)acrylic acid, cinnamic acid, and the like), unsaturated dicarboxylic acids (specifically, maleic acid, fumaric acid, itaconic acid, and the like), and unsaturated dicarboxylic acid monoesters (specifically, monomethyl maleate, monoethylmaleate, monobutyl maleate, monomethyl fumarate, monoethyl fumarate, monobutyl fumarate, and the like); (meth)acrylonitrile; and (meth)acrylamide. These may be used alone or in combination of two or more kinds thereof.

Herein, "(meth)acrylic acid" is a general term for acrylic acid and methacrylic acid, "(meth)acrylonitrile" is a general term for acrylonitrile and methacrylonitrile, and "(meth) acrylamide" is a general term for acrylamide and methacrylamide.

Further, as the other vinylic monomers, a polyfunctional vinylic monomer can be also used. Examples of the polyfunctional vinylic monomer include divinylbenzene, divinylnaphthalene, allyl methacrylate, ethylene glycol di(meth) acrylate, triethylene glycol di(meth)acrylate, 1,3-butylene glycol di(meth)acrylate, 1,6-hexanediol di(meth)acrylate, polybutylene glycol di(meth)acrylate, and trimethylopropane tri(meth)acrylate. These may be used alone or in combination of two or more kinds thereof.

As the polymerization method for producing the component (A), single stage polymerization or sequential multistage polymerization according to an emulsion polymerization method is preferable. However, the polymerization method is not particularly limiter thereto, and for example, the component (A) can be also produced by emulsifying suspension polymerization of performing conversion to a suspension polymerization system at the time of the polymerization of an outermost layer polymer after the emulsion polymerization.

In the production of the component (A), for example, a polymer latex produced by the emulsion polymerization method is separated and recovered by various coagulating agents or separated and recovered as solids by spray drying, and thus the polymer powder thereof can be obtained.

The average particle diameter of the component (A) is preferably 500 μm or less. When the average particle diameter of the component (A) is 500 μm or less, the particle diameter is easily controlled to a monodisperse particle diameter. The lower limit of the average particle diameter of the component (A) is not particularly limited, but from the viewpoint of improving productivity when the component (A) is separated as particles, the average particle diameter is preferably 0.01 μm or more.

It is preferable to use a suspension polymerization method in a case where particles having an average particle diameter of larger than 5 μm among particle diameters of 500 μm or less are desired to be obtained, and it is preferable to select an emulsion polymerization method, dispersion polymerization, and the like in a case where particles having an average particle diameter of 5 μm or less are desired to be obtained. In a case where the storage stability of the toner is decreased due to the influence of an emulsifier, emulsifier-free polymerization may be used.

The average particle diameter of the component (A) is a particle diameter corresponding to a cumulative 50% of a volume distribution basis measured by using a laser diffraction method. Specifically, the average particle diameter is measured as follows.

The particle size distribution of the component (A) is measured by using a laser diffraction particle size analyzer (manufactured by HORIBA, Ltd., "LA-920"). According to the operation manual of the analyzer, a measurement flow cell is used, distilled water is added into the cell the relative refractive index is selected and set to 1.20, the particle diameter basis is regarded as the volume basis, and adjustment of the optical axis, fine adjustment of the optical axis, and blank measurement are conducted. Then, the component (A) is added until the concentration reaches a range of transmittance 70 to 90%, an ultrasonic treatment is conducted at an intensity of 5 for 1 minute, and the particle size distribution measurement of the resin particles is conducted. From the measured particle size distribution, the particle diameter (median diameter) corresponding to a cumulative 50% of the volume distribution basis is regarded as the average particle diameter.

The content of the component (A) in the toner is 5% by mass or less, preferably 0.18 to 2.5% by mass, and more preferably 0.20 to 2.3% by mass in the total of 100% by mass of the in master batch for toners (C) and the polyester resin (B2) (that is, in the total of 100% by mass of the acrylic polymer (A) and the polyester resin (B)). When the content of the component (A) is within the above ranges, the production stability of the toner is further improved. In particular, when the content of the component (A) is 0.18% by mass or more, although specifically described later, the function derived from the component (A) can be sufficiently provided to the toner. On the other hand, when the content of the component (A) is 2.5% by mass or less the fixability of the toner can be favorably maintained.

<Polyester Resin (B)>

The polyester resin (B) (hereinafter, also referred to as "the component (B)") serves as a binder resin.

The component (B) is synthesized by using an acid component and an alcohol component as raw materials. That is, the component (B) is a reaction product of the acid component and the alcohol component.

Examples of the acid component include a divalent carboxylic acid and a trivalent or higher carboxylic acid. Hereinafter, the divalent carboxylic acid and the trivalent or higher carboxylic acid are also referred to collectively as a "polycarboxylic acid."

Examples of the divalent carboxylic acid include terephthalic acid, isophthalic acid, isomers of naphthalene dicarboxylic acid (specifically, 1,4-, 1,5-, 1,6-, 1,7-, 2,5-, 2,6-, 2,7-, and 2,8-naphthalene dicarboxylic acid), and lower alkyl esters thereof; succinic acid, sebacic acid, isodecyl succinic acid, dodecenyl succinic acid, maleic acid, adipic acid, furandicarboxylic acid, and monomethyl, monoethyl, dimethyl, diethyl esters or acid anhydrides thereof; fumaric acid, maleic acid maleic anhydride, citraconic acid, itaconic acid, tetrahydrophthalic acid, and ester derivatives thereof; and acrylic acid, crotonic acid, methacrylic acid, and ester derivatives thereof.

Examples of the lower alkyl esters of terephthalic acid and isophthalic acid include dimethyl terephthalate, dimethyl isophthalate, diethyl terephthalate, diethyl isophthalate, dibutyl terephthalate, and dibutyl isophthalate.

Among these, from the viewpoint of being excellent in the storage stability, handleability, and costs of the toner, terephthalic acid and isophthalic acid are preferable.

These may be used alone or in combination of two or more kinds thereof. Further, these may be used in combination with the trivalent or higher carboxylic acid to be described later.

Examples of the trivalent or higher carboxylic acid include trimellitic acid, pyromellitic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,2,7,8-octanetetracarboxylic acid, and acid anhydrides or lower alkyl esters thereof.

Among these, as the trivalent or higher carboxylic acid, from the viewpoint of being excellent in handleability and costs, trimellitic acid, trimellitic anhydride, pyromellitic acid, and pyromellitic anhydride are preferable.

The proportion of the trivalent or higher carboxylic acid is preferably 50 parts by mole or less, more preferably 30 parts by mole or less, and further preferably 25 parts by mole or less with respect to 100 parts by mole of the acid component. When the proportion of the trivalent or higher carboxylic acid is 50 parts by mole or less, a rapid cross-linking reaction is less likely to occur, and thus the polyester resin (B) with stable quality is obtained. In particular, when the proportion of the trivalent or higher carboxylic acid is 25 parts by mole or less, the glass transition temperature of the polyester resin (B) is easy to arbitrarily control, and thus a toner that is excellent in storage stability is obtained.

The proportion of the trivalent or higher carboxylic acid may be 0 part by mole with respect to 100 parts by mole of the acid component, but in a case where the trivalent or higher carboxylic acid is used as the acid component, the proportion thereof is preferably 0.1 part by mole or more, more preferably 0.5 part by mole or more, and further preferably 1 part by mole or more.

Examples of the alcohol component include a dihydric alcohol and a trihydric or higher alcohol. Hereinafter, the dihydric alcohol and the trihydric or higher alcohol are also referred to collectively as a "polyhydric alcohol."

Examples of the dihydric alcohol include ethylene glycol, neopentyl glycol, propylene glycol, hexanediol, polyethylene glycol, 1,3-propanediol, 1,4-butanediol, diethylene glycol, triethylene glycol, 1,4-cyclohexanedimethanol, D-isosorbide, L-isosorbide, isomannide, erythritane, 1,4-dihydroxy-2-butene, and bisphenol derivatives (specifically, polyoxyethylene-(2.0)-2,2-bis(4-hydroxyphenyl)propane, polyoxypropylene-(2.0)-2,2-bis(4-hydroxyphenyl)propane, polyoxypropylene-(2.3)-2,2-bis(4-hydroxyphenyl)propane, polyoxypropylene)2.2-polyoxyethylene-(2.0)-2,2-bis(4-hydroxyphenyl)propane, polyoxypropylene(6)-2,2bis(4-hydroxyphenyl)propane, polyoxypropylene)2.2)-2,2-bis(4-hydroxyphenyl)propane, polyoxypropylene-(2.4)-2,2-bis(4-hydroxyphenyl)propane, polyoxypropylene(3.3)-2,2-bis(4-hydroxyphenyl)propane, and the like).

Among these, as the dihydric alcohol, from the viewpoint that low-temperature fluidity, storage stability, and pulverization property of the toner can be favorably maintained, ethylene glycol, polyoxyethylene-(2.0)-2,2-bis(4-hydroxy-phenyl)propane, and polyoxypropylene-(2,3)-2,2-bis(4-hydroxyphenyl)propane are preferable.

These may be used alone or in combination of two or more kinds thereof. Further, these may be used in combination with the trihydric or higher alcohol described below.

Examples of the trihydric or higher alcohol include sorbitol, 1,2,3,6-hexatetralol, 1,4-sorbitan, pentaerythritol, dipentaerythritol, tripentaerythritol, 1,2,4-butanetriol, 1,2,5-pentatriol, glycerol, 2-methyl-1,2,3-propanetriol, 2-methyl-1,2,4-butanetriol, trimethylolpropane, 1,3,5-trihydroxymethylbenzene, and glycerin.

Among these, as the trihydric or higher alcohol, from the viewpoint of being excellent in handleability and costs, pentaerythritol, trimethylolpropane, glycerin, and sorbitol are preferable.

As a raw material of the component (B), in addition to the polycarboxylic acid and the polyhydric alcohol, a monovalent carboxylic acid and a monohydric alcohol may be used in combination.

Examples of the monovalent carboxylic acid include aromatic carboxylic acids having 30 or less carbon atoms such as benzoic acid and p-methylbenzoic acid; aliphatic carboxylic acids having 30 or less carbon atoms such as stearic acid and behenic acid; and unsaturated carboxylic acids having one or more unsaturated double bonds in the molecule such as cinnamic acid, oleic acid, linoleic acid, and linolenic acid.

Examples of the monohydric alcohol include aromatic alcohols having 30 or less carbon atoms such as benzyl alcohol; and aliphatic alcohols having 30 or less carbon atoms such as oleyl alcohol, lauryl alcohol, cetyl alcohol, stearyl alcohol and behenyl alcohol.

The method for producing the component (B) is not particularly limited, but the component (B) can be produced by a known method for producing a polyester resin. For example, an acid component, an alcohol component, and the like are charged in a reaction container, the temperature is increased by heating, an esterification reaction or a transesterification reaction is performed, and then water or alcohol produced by the reaction is removed. Thereafter, subsequently, a polymerization reaction is conducted, but at this time, the inside of a reaction apparatus is gradually reduced in pressure, and polycondensation is performed while a diol component is distilled and removed under vacuum of 150 mmHg (20 kPa) or less, preferably 15 mmHg (2 kPa) or less.

A catalyst used at the time of the esterification reaction, the transesterification reaction, and the polycondensation is not particularly limited, and known catalysts such as titanium butoxide, dibutyltin oxide, calcium acetate, calcium acetate hydrate, tin acetate, zinc acetate, tin disulfide, antimony trioxide, and germanium dioxide can be used.

The content of the alcohol component is preferably 180 parts by mole or less, more preferably 70 to 170 parts by mole, further preferably 80 to 160 parts by mole, and particularly preferably 90 to 150 parts by mole with respect to 100 parts by mole of the acid component from the viewpoint of a favorable balance between a softening temperature (T4) and a glass transition temperature (Tg) of the component (B) to be obtained. In particular, when the content of the alcohol component is 90 parts by mole or more, the production stability of the component (B) tends to become favorable, and when the content thereof is 150 parts by mole or less, the glass transition temperature is likely to become higher than the softening temperature, and the storage stability tends to become more favorable.

In particular, the trihydric or higher alcohol is used preferably in 0.1 to 80 parts by mole, more preferably 0.1 to 50 parts by mole, and further preferably 0.1 to 20 parts by mole with respect to 100 parts by mole of the acid component. When the content of the trihydric or higher alcohol is 0.1 part by mole or more, the fixability of the toner becomes favorable. On the other hand, when the content of the trihydric or higher alcohol is 80 parts by mole or less, the production stability of the resin becomes favorable. In particular, when the content of the trihydric or higher alcohol is 20 parts by mole or less, a rapid cross-linking reaction hardly occurs, and thus the polyester resin (B) with stable quality is obtained.

Incidentally, in the case of using the trivalent or higher carboxylic acid and the trihydric or higher alcohol in combination, these components are used such that they are preferably 0.1 to 30 parts by mole, more preferably 0.1 to 25 parts by mole, and further preferably 0.1 to 20 parts by mole in total with respect to 100 parts by mole of the acid component.

Further, the content of the bisphenol derivative is preferably 60 parts by mole or less, more preferably 55 parts by mole or less, and further preferably 50 parts by mole or less with respect to 100 parts by mole of the acid component. When the content of the bisphenol derivative is 60 parts by mole or less, the coloration of the polyester resin (B) is easily lowered without using an additive or the like.

The polycondensation may be performed in the presence of a release agent (wax). By performing the polycondensation in the presence of a release agent, fixability of the toner and wax dispersibility tend to be further improved.

As the release agent, the same release agents as those mentioned as other components to be described later are exemplified, and these may be used alone or in combination of two or more kinds thereof.

The amount of the release agent added at the time of the polycondensation may be appropriately set within a range not impairing the effects of the invention.

The softening temperature (T4) of the component (B) is preferably 70 to 160° C. and more preferably 80 to 155° C. When the softening temperature is 70° C. or higher, fixing strength becomes favorable. On the other hand, when the softening temperature is 160° C. or lower, low-temperature fixability becomes favorable.

The softening temperature of the component (B) can be measured by using a flow tester.

As the component (B), it is preferable to use two or more kinds of polyester resins each having a different softening temperature. When two or more kinds Of polyester resins each having a different softening temperature are used, molecular weight distribution and glass transition temperature are easy to control.

In a case where two or more kinds of polyester resins each having a different softening temperature are used, a difference in softening temperature between these polyester resins is preferably 5° C. or higher and more preferably 10° C. or higher. When, the difference in softening temperature is 5° C. or higher, molecular weight distribution and glass transition temperature are easier to control. The difference in softening temperature is preferably 100° C. or lower.

In particular, from the viewpoint of improving the durability and the low-temperature fixability of the toner, it is preferable to use a polyester resin having a softening temperature of higher than 120° C. and a polyester resin having a softening temperature of 120° C. or lower in combination, and it is preferable to use a polyester resin having a softening temperature of higher than 120° C. and 160° C. or lower and a polyester resin having a softening temperature of 35 to 120° C.

The glass transition temperature (Tg) of the component (B) is preferably 40 to 85° C. and more preferably 45 to 75° C. When the glass transition temperature is 40° C. or higher, the storage stability of the toner is improved, and when the glass transition temperature is 85° C. or lower, the low-temperature fixability of the toner is more excellent.

The glass transition temperature of the component (B) is obtained as follows. That is, a temperature at the intersection between the chart baseline at the low temperate side measured at a temperature increasing rate of 5° C./min and the tangent to the endothermic curve near the glass transition temperature was obtained using a differential scanning calorimeter and this is regarded as Tg.

An acid value of the component (B) is preferably 0.1 to 60 mgKOH/g, more preferably 0.1 to 50 mgKOH/g, and further preferably 1 mgKOH/g or more and less than 30 mgKOH/g. When the acid value is 0.1 mgKOH/g or more, the productivity of the component (B) tends to be improved, and when the acid value is 60 mgKOH/g or less, the moisture resistance of the component (B) is improved so that the toner is less likely to be affected by the usage environment. In particular, when the acid value is less than 30 mgKOH/g, the production stability of the master batch for toners (C) to be described later becomes favorable.

The acid value of the component (B) is the amount of potassium hydroxide, expressed in mg, which is necessary for neutralizing 1 g of a sample.

A mode diameter of the component (B) is preferably 0.3 to 5 mm and more preferably 0.3 to 3 mm. When the mode diameter is 5 mm or less, the production stability of the toner becomes favorable. Incidentally, the mode diameter of the component (B) can be also set to less than 0.3 mm, but in this case, energy for pulverization is required. From the viewpoint of production costs and consumption energy, the mode diameter of the component (B) is preferably 0.3 mm or more.

The mode diameter of the component (B) indicates a mode value (peak particle diameter) of the particle size distribution measured by using a laser diffraction method.

The content of the component (B) is 95% by mass or more, preferably 97.5 to 99.82% by mass, mid more preferably 97.7 to 99.8% by mass in the total of 100% by mass of the master batch for toners (C) and the polyester resin (B2) (that is, in the total of 100% by mass of the acrylic polymer (A) and the polyester resin (B)). When the content of the component (B) is within the above ranges, the production stability of the toner is further improved. In particular, when the content of the component (B) is 97.5% by mass or more, the fixability of the toner can be favorably maintained. On the other hand, when the content of the component (B) is 99.82% by mass or less, although specifically described later, the function derived from the component (A) can be sufficiently provided to the toner.

<Arbitrary Components>

The toner may contain, as necessary, a colorant, a charge control agent, a release agent, a flowability modifier, a magnetic material a resin (another binder resin) other than the component (B), and the like, in addition to the component (A) and the component (B) described above.

Examples of the colorant include carbon black, nigrosine, aniline blue, phthalocyanine blue, phthalocyanine green, Hansa yellow, Rhodamine dyes and pigments, chrome yellow, quinacridone, benzidine yellow, rose bengal, triarylmethane dyes and monoazo, disazo, and condensed azo-based dyes and pigments. These may be used alone or in combination of two or more kinds thereof.

In a case where the toner is used its a color toner, examples of a yellow colorant include benzidine yellow, monoazo dyes and pigments, and condensed azo-based dyes and pigments, examples of a magenta colorant include quinacridone, Rhodamine dyes and pigments, and monoazo dyes and pigments, and examples of a cyan colorant include phthalocyanine blue.

The content of the colorant is not particularly limited, but is preferably 2 to 10% by mass in 100% by mass of the toner from the viewpoint of being excellent in the color tone of the toner, image density, and thermal characteristics.

Examples of the charge control agent include positive charge-type charge control agents such as a quaternary ammonium salt and a basic or electron-donating organic substance; and negative charge-type charge control agents such as metal chelates, a metal-containing dye, and an acidic or electron-withdrawing organic substance.

In a case where the toner used as a color toner, the charge control agent is colorless or pale color, and is suitably a charge control agent with less color tone interference to the toner, and examples of such a charge control agent include a metal salt, a metal complex, an amide compound, a phenol compound, and a naphthol compound of chromium, zinc, and aluminum of salicylic acid or alkylsalicylic acid. Moreover, a styrene-based, an acrylic acid-based, a methacrylic acid-based, or a sulfonic acid group-containing vinyl polymer may be used as the charge control agent.

The content of the charge control agent is preferably 0.5 to 5% by mass in 100% by mass of the toner. When the content of the charge control agent is 0.5% by mass or more, the charge amount of the toner tends to become a sufficient level. When the content thereof is 5% by mass or less, a decrease in charge amount due to aggregation of the charge control agent tends to be suppressed.

Taking mold releasability, storage stability, fixability, color developing property, and the like of the toner into consideration, it is possible to use, as the release agent, carnauba wax, rice wax, beeswax, polypropylene-based wax. polyethylene-based wax, synthetic ester-based wax, paraffin wax, fatty acid amide, silicone-based wax, and the like after being appropriately selected. These may be used alone or in combination of two or more kinds thereof.

The melting point of the release agent may be appropriately determined, taking the performance of the toner info consideration.

The content of the release agent is not particularly limited, but since the content thereof affects the performance of the toner, the content of the release agent is preferably 0.3 to 15% by mass in 100% by mass of the toner. The lower limit of the content of the release agent is more preferably 1% by mass or more and particularly preferably 2% by mass or more. Further, the upper limit of the content of the release agent is more preferably 13% by mass or less and particularly preferably 12% by mass or less.

Examples of an additive such as a flowability modifier include a flowability enhancer such as silica, alumina, and titania which are a fine powder; an inorganic fine powder such as magnetite, ferrite, cerium oxide, strontium titanate, and conductive titania; a resistance adjusting agent such as a styrene resin and an acrylic resin; and a lubricant, and these are used as internal or external additives.

The content of those additives is preferably 0.05 to 10% by mass in 100% by mass of the toner. When the content of those additives is 0.05% by mass or more, performance modifying effects of the toner tend to be sufficiently achieved, and when the content thereof is 10% by mass or less, the image stability of the toner tends to become favorable.

Examples of other binder resins include styrene-based resins, cyclic olefin resins, and epoxy resins. These may be used alone or in combination of two or more kinds thereof.

<Production Method>

The toner is obtained by preparing the master batch for toners (C) by the component (A) and a part of the component (B) and mixing this master batch for toners (C), the remaining component (B), and as necessary, arbitrary components.

Hereinafter, an example of the method for producing a toner will be described.

The method for producing a toner of the present embodiment includes a master batch production step, a first mixing step, a second mixing step, a melting and kneading step, a pulverization step, and a classification step which are described below.

(Master Batch Production Step)

The master batch production step is a step of mixing the acrylic polymer (A) and the polyester resin (B1) to produce the master batch for toners (C).

As the polyester resin (B1), one or more kinds of the aforementioned components (B) can be used. Further, as the polyester resin (B1), two or more kinds of polyester resins each having a different softening temperature may be used.

A known mixer such as a Henschel mixer can be used in the mixing.

The mass ratio represented by the polyester resin (B1)/the acrylic polymer (A) is 2.5 or more. That is, the master batch for toners (C) contains the acrylic polymer (A) and the polyester resin (B1), and the mass ratio represented by the polyester resin (B1)/the acrylic polymer (A) is 2.5 or less.

When the mass ratio is 2.5, or more, the fixability of the toner can be maintained favorably. The mass ratio is preferably 3 or more, more preferably more than 3, and further preferably 3.5 or more.

Further, the mass talks is preferably 10 or less, more preferably 9.5 or less, further preferably 9 or less, and particularly preferably 8.5 or less. When the mass ratio is 10 or less, although specifically described later, the function derived from the component (A) can be sufficiently provided to the toner.

In particular, when the mass ratio is 2.5 to 10, the production stability of the toner is further improved.

(First Mixing Step)

The first mixing step is a step of mixing the master batch for toners (C) obtained by the master batch production step and the polyester resin (B2). Incidentally, a mixture (D) obtained by the first mixing step is also referred to as a "binder resin for toners."

As the polyester resin (B2), one or more kinds of the aforementioned components (B) can be used. Further, as the polyester resin (B2), two or more kinds of polyester resins each having a different softening temperature may be used.

The polyester resin (B2) may be the same type of resin as the polyester resin (B1) used in the master batch production step or may be a different type of resin from the polyester resin (B1).

A known mixed such as a Henschel mixer can be used in the mixing.

The amount of the master batch for toners (C) blended is such an amount that the content of the component (A) is 5% by mass or less, preferably 0.18 to 2.5% by mass, and more preferably 0.20 to 2.3% by mass in the total of 100% by mass of the polyester resin (B2) and the master batch tor toners (C). When the content of the component (A) is within the above ranges, the production stability of the toner is further improved.

Further, the amount of the polyester resin (B2) blended is such an amount that the total of the polyester resin (B2) and the polyester resin (B1) is 95% by mass or more, preferably 97.5 to 99.82% by mass, and more preferably 97.7 to 99.8% by mass in the total of 100% by mass of the polyester resin (B2) and the master batch for toners (C).

(Second Mixing Step)

The second mixing step is a step of mixing the mixture (D) (the binder resin for toners) obtained in the first mixing step and arbitrary components such as a colorant, a charge control agent, and a release agent.

A known mixer such as a Henschel mixer can be used in the mixing.

(Melting and Kneading Step)

The melting and kneading step is a step of melting and kneading a mixture (E) obtained in the second mixing step.

In the melting and kneading, a known kneader can be used. Specific examples of the kneader include continuous melt mixing devices such as a single-screw extruder or a twin-screw extruder, a continuous sealed mixer, a gear extruder, a disc extruder, a roll mill extruder, and a static mixer, and batch sealed melt mixing device such as a Banbury mixer, a Brabender mixer, and a Haake mixer. Among these, from the viewpoint that arbitrary components can be efficiently dispersed in the mixture (D) in a short time, continuous melt mixing devices are more preferably used.

In a case where the static mixer is used as a kneader, a method is exemplified m which the mixture (D) is melted at a temperature range of 90° C. to 250° C. and fed using a known gear pump or the like, and the mixtures (D) are mixed or the mixture (D) and arbitrary components are mixed.

Specific preferable examples of the static mixer are not particularly limited, but for example, the following mixers are mentioned. These are industrially available.

- Sulzer Mixer SMX Type manufactured by MIDORIKIKAIKOUGYO LTD. (SMX-15A: 6 elements, 12 elements), pipe 25A (inner diameter: 27.2 mm)
- NS Mixer manufactured by TOKYO NISSHIN JABARA CO., LTD. (WB-15A: 24 elements), pipe 15A (inner diameter: 16.1 mm)
- Static Mixer manufactured by NORITAKE CO., LIMITED (15A: 24 elements), inner diameter: 5 mm (Pulverization Step)

The pulverization step is a step of pulverizing the kneaded product (F) obtained in the melting and kneading step.

When the kneaded product (F) is pulverized, it is preferable to perform fine pulverization after the kneaded product (F) is coarsely pulverized.

A known pulverizer such as a chopper mill can be used in the pulverization.

(Classification Step)

The classification step is a step for classifying the pulverized product (G) obtained in the pulverization step to have a desired particle diameter.

In classification, a known classifier can be used.

<Action and Effect>

As described above, the master batch for toners (C) is prepared by the component (A) and a part of the component (B) are mixed. Thus, the mixture (D) in which the component(A) and the component (B) are uniformly mixed is obtained. Therefore, even when this mixture (D) and arbitrary components are mixed, a mixture (F) in which toner components are uniformly mixed is obtained, and a toner with less variation in toner performance can be stably produced.

As the difference in particle diameter between the component (A) and the component (B) increases, only by simply mixing the component (A) and the component (B), both the component (A) and the component (B) are less likely to be uniformly mixed; however, when the master batch tor toners (C) is prepared in advance as described above, even if the difference in particle diameter between the component (A) and the component (B) increases, the mixture (D) in which the component (A) and the component (B) are uniformly mixed is obtained.

Incidentally, the method for producing a toner is not limited to the aforementioned method, and for example, an external addition treatment of inorganic particles may be performed as necessary after the classification step.

Further, a pulverization method is applied to the aforementioned method, or a chemical method may be applied. In a case where the chemical method is applied, for example, after the mixture (E) is obtained through the master batch production step, the first mixing step and the second mixing step described above, the mixture (E) is dissolved or dispersed in a solvent and granulated in an aqueous medium, then the solvent is removed therefrom, and the grannies are washed and dried, so that a toner can be obtained. Further, after drying, as necessary, an external addition treatment of inorganic particles, or the like may be performed.

<Use Application>

The toner of the invention can also be used as any developer of a magnetic one-component developer, a non-magnetic one-component developer, and a two-component developer.

In a case where the toner of the invention is used as a magnetic one-component developer, the toner contains a magnetic material. Examples of the magnetic material include ferromagnetic alloys such as ferrite, magnetite, iron, cobalt, and nickel; and compounds and alloys that do not contain ferromagnetic elements but become ferromagnetic when appropriately treated by applying heat (for example, chromium dioxides, so-called Heusler alloys containing manganese and copper such as manganese-copper-aluminum and manganese-copper-tin).

The content of the magnetic material is particularly limited, but is preferably 3 to 70% by mass in 100% by mass of the toner since a magnetic material significantly affects the pulverization property of the toner. When the content of the toner is 3% by mass or more, the charge amount of the toner tends to be sufficient, and when the content thereof is 70% by mass or less, fixability and pulverization property of the toner tends to be favorable. The upper limit of the content of the magnetic material is more preferably 60% by mass or less and particularly preferably 50% by mass or less.

In a case where the toner of the invention is used as a two-component developer, the toner of the invention is used in combination with a carrier.

Examples of the carrier include magnetic substances such as iron powder, magnetite powder, and ferrite powder, carriers obtained by resin-coating those substances, and magnetic carriers. Examples of coating resins for forming resin-coated carriers include styrene-based resins, acrylic resins, styrene-acrylic resins, silicone-based resins, modified silicone-based resins, fluorine-based resins, and mixtures of those resins.

The amount of the carrier used is preferably 500 to 3000 parts by mass with, respect to 100 parts by mass of the toner. When the amount of the carrier used is 500 parts by mass or more, fogging or the like lends to be less likely to occur, and when the amount thereof is 3000 parts by mass or less, the density of a fixed image tends to be sufficient <Other Embodiments>

The component (A) contained in the toner and the master batch for toners (C) can provide a function corresponding to the type thereof to the toner.

For example, in a case where the component (A) is the polymer having a gycidyl (meth)acrylate unit (hereinafter, also referred to as the "polymer (A1)"), the cross-linking reaction between an acid and an epoxy group occurs due to heat at the lime of kneading in the production of the toner, and thus high-temperature elasticity can be provided to the toner. Specifically, a toner having a storage elastic modulus (G') at 200° C. of 200 to 10,000 Pa is obtained. However, when the cross-linking reaction occurs, the glass transition temperature of the toner also tends to increase. Thus, the resin may be hardly softened at a low temperature and low-temperature fixability may deteriorate. When the polymer having a glycidyl (meth)acrylate unit is formed as a resin master batch, it is possible to suppress the glass transition temperature of the toner (specifically, the glass transition temperature of the toner is easily adjusted to 65° C. or lower), performance trade-off between low-temperature fixability and high-temperature elasticity can be achieved.

Further, in a case where the component (A) is a polymer having two or more kinds of units selected front the group consisting of a methyl methacrylate unit, a n-butyl methacrylate unit, a n-butyl acrylate unit, and an isobutyl methacrylate unit (hereinafter, also referred to as the "polymer (A2)"), material dispersibility can be provided to the toner.

The toner and the master batch for toners (C) may contain any one of the polymer (A1) and the polymer (A2) or may contain the both the polymers.

Hereinafter, the polymer (A1) and the polymer (A2) will be described in detail.

(Polymer (A1))

The polymer (A1) is a polymer having a glycidyl (meth) acrylate unit.

The content of the glycidyl (meth)acrylate unit is preferably 5% by mass or more, more preferably 20% by mass or more, and further preferably 35% by mass or more when the total of all monomer units constituting the polymer (A1) is regarded as 100% by mass. When the content of the glycidyl (meth)acrylate unit in the polymer (A1) is 5% by mass or more, the toner is likely to exhibit high-temperature elasticity.

The polymer (A1) may be configured by only the glycidyl (meth)acrylate unit or may have other monomer units.

Examples of the other monomers constituting the other monomer units include alkyl (meth)acrylates such as methyl (meth)acrylate, ethyl (meth)acrylate, propyl (meth)acrylate, butyl (meth)acrylate, and 2-ethylhexyl (meth)acrylate; cyclohexyl (meth)acrylate; phenyl (meth)acrylate; aromatic vinylic monomers such as styrene, α-methylstyrene, and vinyl toluene; and (meth)acrylonitrile. These may be used alone or in combination of two or more kinds thereof.

Among these, as the other monomers, methyl methacrylate is preferable.

The content of other monomer units is preferably 95% by mass or less, more preferably 80% by mass or less, and further preferably 65% by mass or less in the total of 100% by mass of the entire monomer unit constituting the polymer (A1).

The glass transition temperature (Tg) of the polymer (A1) is preferably 0 to 150° C. and more preferably 30 to 90° C.

When the glass transition temperature is 0° C. or higher, handleability becomes favorable, and when the glass transition temperature is 150° C. or lower, the melting rate in the aforementioned melting and kneading step can be increased.

The glass transition temperature of the polymer (A1) is obtained from the Fox equation represented in the following Equation (1).

$$1/Tg=\Sigma(Wi/Tgi) \quad (1)$$

In Equation (1), Wi represents a mass ratio of a monomer i with respect to the entire monomer, and Tgi represents Tg of a homopolymer of the monomer i.

The numerical value described in POLYMER HANDBOOK THIRD EDITION (WILEY INTERSCIENCE) can be used as the numerical value of Tg of the homopolymer.

The epoxy equivalent of the polymer (A1) is preferably 10 to 5,000 g/eq, more preferably 20 to 4,800 g/eq, and further preferably 50 to 4,500 g/eq. When the epoxy equivalent is within the above ranges, the toner is more likely to exhibit high-temperature elasticity.

The epoxy equivalent of the polymer (A1) is an epoxy equivalent measured by a method including the following (i) to (vi).

(i) 2 g of hydrochloric acid is put in a 100 mL measuring flask and is diluted to 100 mL with an ethanol/dioxane solution of ethanol/dioxane=20/80 to prepare Liquid A.

(ii) 0.15 to 0.20 g of a sample is precisely weighed out in a 100 mL Erlenmeyer flask with a stopper, 20 mL of dioxane is added into the flask, and ultrasonic waves are applied to the resulting mixture for about 1 hour by means of an ultrasonic cleaning machine to dissolve the sample in dioxane. A liquid temperature at the time of dissolving the sample is about 40° C.

(iii) After the sample is dissolved, 10 mL of Liquid A is added into the Erlenmeyer flask.

(iv) The sample solution after the addition of Liquid A is titrated with a 0.1 mole/1-KOH (ethanol) with the use of phenolphthalein as an indicator.

(v) A blank liquid is also titrated at the same time.

(vi) The epoxy equivalent is calculated from the amount of the sample and the amounts for the titration of the sample solution and the blank liquid.

The mass average molecular weight of the polymer(A1) is preferably 3,000 to 100,000 and more preferably 5,000 to 80,000 from the viewpoint of polymerization property.

The mass average molecular weight of the polymer (A1) can be measured by using gel permeation chromatography (GPC). For example, the mass average molecular weight can be obtained as a polymethyl methacrylate equivalent molecular weight by using a solvent such as tetrahydrofuran or water as an eluent.

From the viewpoint of handleability and easy blending with the component (B), the form of the polymer (A1) is preferably a spherical particle form.

As the polymerization method for the polymer (A1), known polymerization methods such as bulk polymerization, solution polymerization, suspension polymerization, and emulsion polymerization can be applied. Among these, since a polymer having a spherical particle form can be easily obtained, suspension polymerization, is preferable.

Examples of a polymerization initiator to be used for the polymerization for the polymer (A1) include azo compounds such as 2,2'-azobisisobutyronitrile, 2,2'-azobis(2-methylbutryonitrile), and 2,2'-azobis(2,4-dimethylvaleronitrile); organic peroxides such as benzoyl peroxide, lauroyl peroxide, 1-butylperoxy-2-ethylhexanoate, t-hexylperoxy-2-ethylhexanoate, 1,1,3,3-tetramethylbutylperoxy-2-ethylhexanoate, and t-hexylhydroperoxide; inorganic peroxides such as hydrogen peroxide, sodium persulfate, and ammonium persulfate.

Among these, as the polymerization initiator, 2,2'-azobis(2,4-dimethylvaleronitrile) is preferable.

In the polymerization for the polymer (A1), a chain transfer agent can be used as necessary.

Examples of the chain transfer agent include mercaptans such as n-dodecylmercaptan; thioglycolates such as octyl thioglycolate; and α-methylstyrene dimer. Among these, as the chain transfer agent, n-dodecylmercaptan is preferable.

Examples of a dispersant to be used for the suspension polymerization for the polymer (A1) include poorly water-soluble inorganic compounds such as calcium phosphate, calcium carbonate, aluminum hydroxide, and silica powder nonionic polymer compounds such as polyvinyl alcohols, polyethylene oxides, and cellulose derivatives; and anionic polymer compounds such as alkali metal poly(meth)acrylates, alkali metal salts of copolymers of (meth)acrylic acid and methyl (meth)acrylate, and copolymers of alkali metal (meth)acrylate, methyl (meth)acrylate, and alkali metal (meth)acrylate sulfate.

Among these, as the dispersant, copolymers of alkali metal (meth)acrylate, methyl (meth)acrylate, and alkali metal (meth)acrylate sulfate is preferable Commercially available products can be used as the polymer (A1), and examples thereof include MATABLEN P-1900, P-1901, KP-6562, and KP-7653 (product name) manufactured by Mitsubishi Rayon Co., Ltd.

The mode diameter of the polymer (A1) to be obtained by a known method such as suspension polymerization is about 50 to 250 μm.

On the other hand, the mode diameter of the component (B) is preferably 0.3 to 5 mm as described above. For this reason, a difference in particle diameter between the polymer (A1) and the component (B) is large and both the polymer (A1) and the component (B) are less likely to be uniformly mixed.

However, as described above, the master batch for toners (C) is prepared by the polymer (A1) and a part of the component (B), and this master batch for toners (C) and the remaining component (B) are mixed. Thus, the mixture (D) in which the polymer (A1) and the component (B) are uniformly mixed is obtained. Therefore, even when this mixture (D) and arbitrary components ate mixed, the mixture (F) in which toner components are uniformly mixed is obtained, and a toner with less variation in toner performance can be stably produced.

Therefore, the effect of the polymer (A1) is sufficiently exhibited and a toner that is excellent in high-temperature elasticity is stably obtained.

Incidentally, when the mode diameter of the component (B) is controlled to be substantially equal to the mode diameter of the polymer (A1), the difference in particle, diameter is decreased, and thus it is considered that both the component (B) and the polymer (A1) are uniformly mixed without the master batch for toners (C) being prepared in advance.

However, since energy is required for pulverizing the component (B), the production costs are increased.

According to the method in which the master batch for toners (C) is prepared in advance, since it is not necessary to pulverize the component (B) until the mode diameter of the component (B) is substantially equal to the mode diameter of the polymer (A1), the production costs and consumption energy can be reduced.

(Polymer (A2))

The polymer (A2) is a polymer having two or more kinds of units selected from the group consisting of a methyl methacrylate unit, a n-butyl methacrylate unit, a n-butyl acrylate unit, and an isobutyl methacrylate unit.

As the polymer (A2), a polymer having a methyl methacrylate unit, a n-butyl methacrylate unit, and a n-butyl acrylate unit is preferable.

The content of the methyl methacrylate unit is preferably 30 to 85% by mole, more preferably 35 to 80% by mole, and further preferably 40 to 80% by mole when the total of the whole monomer units constituting the polymer (A2) is regarded as 100% by mole. When the content of the methyl methacrylate unit in the polymer (A2) is 30% by mole or more, storage stability becomes favorable, and when the content thereof is 85% by mole or less, the balance between dispersibility and fixability can be achieved.

The content of the n-butyl methacrylate unit is preferably 1 to 50% by mole, more preferably 5 to 45% by mole, and further preferably 5 to 40% by mole when the total of the whole monomer units constituting the polymer (A2) is regarded as 100% by mole. When the content of the n-butyl methacrylate unit in the polymer (A2) is 1% by mole or more, material dispersibility becomes more favorable, and when the content thereof is 50% by mole or less, storage stability becomes favorable.

The content of the n-butyl acrylate unit is preferably 1 to 50% by mole, more preferably 5 to 45% by mole, and further preferably 5 to 40% by mole when the total of the whole monomer units constituting the polymer (A2) is regarded as 100% by mole. When the content of the n-butyl acrylate unit in the polymer (A2) is 1% by mole or more, material dispersibility becomes more favorable, and when the content thereof is 50% by mole or less, storage stability becomes favorable.

The content of the isobutyl methacrylate unit is preferably 1 to 99% by mole, more preferably 10 to 99% by mole, and further preferably 20 to 99% by mole when the total of the whole monomer units constituting the polymer (A2) is regarded as 100% by mole. When the content of the isobutyl methacrylate unit in the polymer (A2) is within the above ranges, material dispersibility becomes more favorable.

The polymer (A2) may be configured by only two or more kinds of the methyl methacrylate unit, the n-butyl methacrylate unit, the n-butyl acrylate unit, and the isobutyl methacrylate unit, and may have other monomer units.

Examples of other monomers constituting the other monomer units include (meth)acrylates of straight alkyl alcohols such as methyl acrylate, ethyl (meth)acrylate, i-butyl acrylate, t-butyl (meth)acrylate, hexyl (meth)acrylate, 2-ethylhexyl (meth)acrylate, octyl (meth)acrylate, and lauryl (meth)acrylate; (meth)acrylates of cyclic alkyl alcohols such as cyclohexyl (meth)acrylate; carboxy group-containing monomers such as methacrylic acid, acrylic acid, itaconic acid, crotonic acid, maleic acid, fumaric acid, 2-succinoloyloxyethyl methacrylate-2-methacryloyloxy ethyl succinic acid, 2-maleinoloyloxyethyl methacrylate-2-methacryloyloxyethyl maleic acid, 2-phthaloyloxyethyl methacrylate-2-methacryloyloxyethyl phthalic acid, and 2-hexahydrophthaloyloxyethyl methacrylate-2-methacryloyloxyethyl hexahydrophthalic acid; sulfonic acid group-containing monomers such as allyl sulfonic acid; carbonyl group-containing (meth)acrylates such as acetoacetoxy ethyl (meth)acrylate; hydroxy group-containing (meth)acrylates such as 2-hydroxycyclohexyl (meth)acrylate and 2-hydroxypropyl (meth)acrylate; epoxy group-containing (meth)acrylates such as glycidyl (meth)acrylate and N-diethylaminoethyl (meth)acrylate; polyfunctional (meth)acrylates such as (poly)ethylene glycol di(meth)acrylate, propylene glycol di(meth)acrylate, 1,6-hexanediol di(meth)acrylate, and trimethylolpropane tri(meth)acrylate; acrylamides and derivatives thereof (for example, diacetone acrylamide, N-methylol acrylamide, N-methoxy methyl acrylamide, N-ethoxy methyl acrylamide, N-butoxy methyl acrylamide, and the like); styrenes and derivatives thereof; vinyl acetate; urethane-modified acrylates; epoxy-modified acrylates; and silicone-modified acrylates. These may be used alone or in combination of two or more kinds thereof.

Among these, as the other monomers, methyl acrylate, i-butyl acrylate, t-butyl (meth)acrylate, 2-ethylhexyl (meth) acrylate, and lauryl (meth)acrylate are preferable.

The content of the other monomer units is preferably 25% by mass or less, more preferably 20% by mass or less, and further preferably 15% by mass or less in the total of 100% by mass of all monomer units constituting the polymer (A2).

The polymer (A2) is preferably a polymer which has two or more stages of polymer layers each having a different composition in a concentric circle shape from the particle center part thereof to the surface layer part. When a particle structure having two or more stages of polymer layers in a concentric circle shape from the center part of the particle to the surface layer part is formed using polymer components each having a different composition, storage stability and heat moldability can be enhanced.

Specific examples of such a particle structure include a core-shell type formed from two layers of a core polymer and a shell polymer, a multi-stage type formed from a layer structure of three or more stages, and a gradient type in which those layers are formed to be extremely thin and which has continuously approximate compositional change. Among these, from the viewpoint of ease of preparation of polymer particles, a core-shell type particle structure is preferable, but the particle structure is not limited thereto.

As the method for polymerizing the polymer (A2) having a particle structure such as a core-shell type, a multi-stage type, or a gradient type, known polymerization methods such as emulsion polymerization, seed emulsion polymerization, soap-free emulsion polymerization, suspension polymerization, and fine suspension polymerization, in the aqueous medium are applicable. Among these, from the viewpoint of easily controlling the particle structure, emulsion polymerization, seed emulsion polymerization, and soap-free emulsion polymerization are preferable. Further, from the view-point of obtaining primary particles having a relatively large particle diameter, soap-free emulsion polymerization and fine suspension polymerization are preferable.

Incidentally, since it is general that the polymer (A2) to be obtained by these polymerization techniques is obtained as a dispersion in which the polymer (A2) is dispersed in a medium solution, a step of recovering the polymer (A2) from the polymer dispersion is required. As a method to be used in the recovering step, known methods such as a spray drying method, a coagulation method, a freeze drying method, a centrifugation method, and a filtration method can be used. Among these, the spray drying method is excellent in terms of ease of controlling properties of particles, productivity, and the like.

Hereinafter, examples of the core-shell type polymer (A2) and the multi-stage type polymer (A2) will be described, respectively.

Core-Shell Type:

As the core-shell type polymer (A2), for example, polymers having a core-shell structure in which a core portion is a copolymer of a monomer mixture (c) described below and a shell portion is a copolymer of a monomer mixture(s) described below, and the like are mentioned.

Monomer mixture (c): the mixture contains methyl methacrylate, a (meth)acrylic acid ester of aliphatic alcohol and/or aromatic alcohol having 2 to 8 carbon atoms, and as necessary, other copolymerizable monomers.

Monomer mixture (s): the mixture contains methyl methacrylate, a (meth)acrylic acid ester of aliphatic alcohol and/or aromatic alcohol having 2 to 8 carbon atoms, a carboxy group or sulfonic acid group-containing monomer, and as necessary, other copolymerizable monomers.

However, at least one of the monomer mixture (c) and the monomer mixture (s) contains n-butyl methacrylate. Further, at least one of the monomer mixture (c) and the monomer mixture (s) contains n-butyl acrylate.

Examples of the (meth)acrylic acid ester of aliphatic alcohol having 2 to 8 carbon atoms include ethyl (meth) acrylate, n-butyl (meth)acrylate, i-butyl (meth)acrylate, t-butyl (meth)acrylate, cyclohexyl (meth)acrylate, and 2-ethylhexyl (meth)acrylate.

Examples of the (meth)acrylic acid ester of aromatic alcohol having 2 to 8 carbon atoms include benzil (meth) acrylate.

These may be used alone or in combination of two or more thereof.

Examples of the carboxy group or sulfonic acid group-containing monomer include (meth)acrylic acid, itaconic acid, crotonic acid, maleic acid, fumaric acid, allyl sulfonate, and vinyl sulfonate. These maybe used alone or in combination of two or more kinds thereof.

Other copolymerizable monomers are not particularly limited as long as they are copolymerizable with the above-described acrylic monomers, but examples thereof include (meth)acrylates of alcohol having 9 or more carbon atoms such as stearyl (meth)acrylate, and lauryl (meth)acrylate; (meth)acrylates having a functional group other than a carboxy group and a sulfonic acid such as 2-hydroxycyclohexyl (meth)acrylate, 2-hydroxypropyl (meth)acrylate, glycidyl (meth)acrylate, and acetoxyethyl (meth)acrylate; acrylamides and derivatives thereof (specifically, diacetone acrylamide, N-methylol acrylamide, N-methoxy methylacrylamide, N-ethoxyethyl acrylamide, N-butoxy methylacrylamide, and the like); styrenes and derivatives thereof, vinyl acetate; butadiene; acryl-modified silicone-based monomers; acryl-modified expoxy monomers; and acryl-modified urethane monomers.

As the other copolymerizable monomer include, a polyfunctional monomer, specifically, a crosslinkable monomer such as ethylene glycol di(meth)acrylate, propylene glycol di(meth)acrylate, 1,4-butanediol di(meth)acrylate, 1,6-hexanediol di(meth)acrylate, 1,9-nonanediol di(meth)acrylate, polyethylene oxides di(meth)acrylate, glycerol di(meth)acrylate, trimethylolpropane tri(meth)acrylate, or divinylbenzene can be also used.

When the total of all monomers contained in the monomer mixture (c) is regarded as 100% by mole, the content of methyl methacrylate in the monomer mixture (c) is preferably 20 to 85% by mole, the content of the (meth)acrylic acid ester of aliphatic alcohol and/or aromatic alcohol having 2 to 8 carbon atoms is preferably 15 to 80% by mole, and the content of the other copolymerizable monomers is preferably 30% by mole or less.

Regarding the preferable composition of the monomer mixture (c), when the total of the monomers is regarded as 100% by mole, methyl methacrylate is 20 to 70% by mole, one or more kinds of (meth)acrylic acid ester selected from the group consisting of m-butyl (meth)acrylate, i-butyl (meth)acrylate, and t-butyl (meth)acrylate are 30 to 80% by mole, and the other copolymerizable monomers are 20% by mole or less.

Regarding the further preferable composition, when the total of the monomers is regarded as 100% by mole, methyl methacrylate is 20 to 70% by mole, one or more kinds of (meth)acrylic acid ester selected from the group consisting on n-butyl (meth)acrylate, i-butyl (meth)acrylate, and t-butyl (meth)acrylate are 30 to 80% by mole, and the other copolymerizable monomers are 10% by mole or less.

In the monomer mixture(s), when the total of all monomers contained in the monomer mixture(s) is regarded as 100% by mole, the content of methyl methacrylate is preferably 20 to 94.5% by mole, the content of the (meth)acrylic acid ester of aliphatic alcohol and/or aromatic alcohol having 2 to 8 carbon atoms is preferably 5 to 40% by mole, the content of the carboxy group or sulfonic acid group-containing monomer is preferably 0.5 to 10% by mole, and the content of the other copolymerizable monomers is preferably 30% by mole or less.

Regarding the preferable composition of the monomer mixture(s), when the total of the monomers is regarded as 100% by mole, methyl methacrylate is 30 to 79.5% by mole, one or more kinds of (meth)acrylic acid ester selected from the group consisting of n-butyl meth)acrylate, i-butyl (meth) acrylate, and t-butyl (meth)acrylate are 5 to 40% by mole, the carboxy group-containing acrylic monomer is 0.5 to 10% by mole, and the other copolymerizable monomers are 20% by mole or less.

Regarding the further preferable composition, when the total of the monomers is regarded as 100% by mole, methyl methacrylate is 55 to 79.5% by mole, one or more kinds of (meth)acrylic acid ester selected from the group consisting of n-butyl (meth)acrylate, i-butyl (meth)acrylate, and t-butyl (meth)acrylate are 20 to 40% by mole, the carboxy group-containing acrylic monomer is 0.5 to 10% by mole, and the other copolymerizable monomers are 10% by mole or less.

The mass ratio represented by the core portion/the shell portion preferably 10/90 to 90/10. When the mass ratio of the core portion is 10 or more or the mass ratio of the shell portion is 90 or less, material dispersibility tends to become more favorable. When the mass ratio of the core portion is 90 or less or the mass ratio of the shell portion is 10 or more, storage stability tends to become favorable.

The glass transition temperature (Tg) of the core portion is preferably 30° C. or lower, more preferably −60 to 30° C., and further preferably −4 to 10° C. When the transition temperature of the core portion is 30° C. or lower, flexibility and elasticity can be provided to the toner.

The glass transition temperature (Tg) of the shell portion is preferably 50° C. or higher, more preferably 50 to 100° C., and further preferably 55 to 105° C. When the transition temperature of the shell portion is 50° C. or higher, storage stability becomes favorable.

The transition temperatures of the core portion and the shell portion are obtained from the Fox equation represented in the above-described Equation (1).

Multi-Stage Type:

As the multi-stage type polymer (A), for example, a three-stage polymer, which is obtained by polymerizing a monomer component (1) containing alkyl (meth)acrylate having 1 to 18 carbon atoms in the presence of a polymer (α) containing a methyl methacrylate unit and by polymerizing a monomer component (2) containing methyl methacrylate in the presence the obtained polymer (β), and the like are exemplified.

However, at least one of the monomer component (1) and the monomer component (2) contains n-butyl methacrylate. Further, at least one of the monomer component (1) and the monomer component (2) contains n-butyl acrylate.

The content of the methyl methacrylate unit in the polymer (α) is preferably 80% by mass or more and more preferably 85% by mass or more when the total of all monomer units constituting the polymer (α) is regarded as 100% by mass. When the content of the methyl methacrylate unit in the polymer (α) is 80% by mass or more, the material dispersibility of the toner can be further increased.

The polymer (α) may be configured by only the methyl methacrylate unit or may have other monomer units.

Examples of the other monomers constituting the other monomer units include aromatic vinyl, unsaturated nitrile, vinyl ester, alkyl acrylate, and alkyl methacrylate other than methyl methacrylate. These may be used alone or in combination of two or more kinds thereof.

The content of the other monomer units in the polymer (α) is preferably 20% by mass or less and more preferably 15% by mass or less when the total of all monomer units constituting the polymer (α) is regarded as 100% by mass.

A reduced viscosity of the polymer (α) is preferably 2 dL/g or more. When the reduced viscosity is 2 dL/g or more, the effect of the polymer (A2) is likely to be further exhibited.

The reduced viscosity of the polymer (α) is a value measured the reduced viscosity of a solution having 0.1 g of the polymer (α) dissolved in 100 mL of chloroform at a liquid temperature of 25° C.

Examples of the alkyl(meth)acrylate having 1 to 18 carbon atoms include ethyl (meth)acrylate, n-butyl (meth) acrylate, i-butyl (meth)acrylate, 2-ethylhexyl (meth)acrylate, and benzil methacrylate. These may be used alone or in combination of two or more kinds thereof.

Regarding the preferable composition of the monomer component (1), alkyl acrylate having 1 to 18 carbon atoms is 30 to 70% by mass and alkyl methacrylate having 1 to 18 carbon atoms is 30 to 70% by mass.

The monomer component (2) may contain a monomer other than methyl methacrylate (for example, aromatic vinyl, unsaturated nitrile, vinyl ester, alkyl acrylate, alkyl methacrylate other than methyl methacrylate, or the like).

Regarding the preferable composition of the monomer component (2), methyl methacrylate is 50 to 100% by mass and the monomer other than methyl methacrylate is 50% by mass or less.

Further preferably, methyl methacrylate is 100% by mass.

In the multi-stage polymerization, it is preferable that 40 to 70 parts by mass of the monomer component (1) is polymerized in the presence of 10 to 45 parts by mass of the polymer (α) under the condition that the reduced viscosity of the monomer component (1) is 1 dL/g or less, preferably 0.2 to 0.8 dL/g, and then 5 to 40 parts by mass of the monomer component (2) is polymerized in the presence of the obtained polymer (α) under the condition that the reduced viscosity of the monomer component (2) is 2 or more, incidentally, the total of the polymer (α), the monomer component (1), and the monomer component (2) is regarded as 100 parts by mass.

When the multi-stage polymerization is performed under such a condition, a so-called sandwich structure in which a relatively high-molecular weight polymer is arranged at the inner side and the outer side of the polymer (α) having a relatively low-molecular weight can be easily obtained.

Commercially available products can be used as the polymer (A2), and examples thereof include MATABLEN L-1000, L-1030, LP-3207, P-700, P-710, KP-9859, and the like (product name) manufactured by Mitsubishi Rayon Co., Ltd.

The mode diameter of the polymer (A2) to be obtained by a known method such as emulsion polymerization is about 50 to 250 μm.

On the other hand, the mode diameter of the component (B) is preferably 0.3 to 5 mm as described above. For this reason, a difference in particle diameter between the polymer (A2) and the component (B) is large and both the polymer (A2) and the component (B) are less likely to be uniformly mixed.

However, as described above, the master batch for toners (C) is prepared by the polymer (A2) and a part of the component (B), and this master batch for toners (C) and the remaining component (B) are mixed. Thus, the mixture (D) in which the polymer (A2) and the component (B) are uniformly mixed is obtained. Therefore, even when this mixture (D) and arbitrary components are mixed, the mixture (F) in which toner components are uniformly mixed is obtained, and a toner with less variation in toner performance can be stably produced.

Therefore, the effect of the polymer (A2) is sufficiently exhibited and a toner that is excellent in dispersibility of a release agent such as a wax is stably obtained.

Incidentally, when the mode diameter of the component (B) is controlled to be substantially equal to the mode diameter of the polymer (A2), the difference in particle diameter is decreased, and thus it is considered that both the component (B) and the polymer (A2) are uniformly mixed without the master batch for toners (C) being prepared in advance.

However, since energy is required for pulverizing the component (B), the production costs are increased.

According to the method in which the master batch for toners (C) is prepared in advance, since it is not necessary to pulverize the component (B) until the mode diameter of the component (B) is substantially equal to the mode diameter of the polymer (A2), the production costs and consumption energy can be reduced.

EXAMPLES

Hereinafter, the invention will be described in detail by means of Examples. However, the invention is not limited to the following Examples.

[Component (A)]

Following Compounds were used as the component(A).

A-1: Homopolymer of glycidyl methacrylate (manufactured by Mitsubishi Rayon Co., Ltd., "P-1900", mode diameter 100 μm, number average molecular weight (Mn): 4,400, mass average molecular weight (Mw): 16,100, peak top molecular weight (Mp): 10,800)

A-2: Polymer having a core-shell structure formed by a core portion composed of a copolymer of methyl methacrylate, n-butyl methacrylate, and n-butyl acrylate and a shell portion composed of a copolymer of methyl methacrylate, n-butyl methacrylate, and n-butyl acrylate (manufactured by Mitsubishi Rayon Co., Ltd., "L-1000", mode diameter: 100 μm, number average molecular weight (Mn): 4,500. mass average molecular weight (Mw): 157,000, peak top molecular weight (Mp): 155,000)

A-3: Polymer having a core-shell structure formed by a core portion composed of a copolymer of methyl methacrylate and isobutyl methacrylate and a shell portion composed of a homopolymer of methyl methacrylate (manufactured by Mitsubishi Rayon Co., Ltd., "LP-3207", mode diameter: 36 μm, number average molecular weight (Mn): 81,300, mass average molecular weight (Mw): 917,000, peak top molecular weight (Mp): 985,800)

Incidentally the mode diameter of the polymer was obtained by the similar measurement method to that of the mode diameter of the polyester resin to be described later.

Further, the molecular weight of the polymer was measured as a molecular weight in terms of polystyrene by using GPC and tetrahydrofuran as an eluent.

[Component (B)]

B-1 to B-6 were produced as follows.

Polycarboxylic acid, polyhydric alcohol, and a wax which have charging compositions presented in Table 1, and a titanium alkoxide catalyst (tetrabutoxy titanium) at 500 ppm with respect to the polycarboxylic acid were introduced into a reaction container equipped with a distillation column. Incidentally, the amount of the wax is an amount (% by mass) when the total of the polyfunctional carboxylic acid, the polyfunctional alcohol, and the wax was regarded as 100% by mass.

Subsequently, the rotation speed of the stirring blade in the reaction container was kept at 120 rpm, the temperature increase was started, the reaction system was heated so as to have an inner temperature of 265° C., and the esterification reaction was performed while this temperature was maintained. The temperature in the reaction system was lowered after the discharge of water from the reaction system was terminated and the esterification reaction was completed, the pressure in the reaction vessel was reduced over about 40 minutes while maintaining the temperature at 240° C., the degree of vacuum was set to 133 Pa, and the polycondensation reaction was conducted while the polyhydric alcohol was discharged from the reaction system.

The viscosity of the reaction system increased as the reaction proceeded, the degree of vacuum was increased along with an increase in viscosity, and the polycondensation reaction was conducted until the torque of the stirring blade became the value indicating the desired softening temperature. Thereafter, stirring was stopped at the time point at which the predetermined torque was indicated. The pressure of the reaction system was caused to return normal pressure, and the reaction product was taken out by pressurizing with nitrogen, thereby obtaining polyester resins (B-1) to (B-6). Incidentally, the polymerization end point of the polyester resins (B-1) to (B-4) was determined by performing sampling during the polymerization and measuring the softening temperature.

The glass transition temperature (Tg), the softening temperature (T4), the acid value, and the mode diameter of the obtained polyester resins were measured as follows. The results thereof are presented in Table 1.

<Measurement of Glass Transition Temperature (Tg)>

A glass transition temperature of the polyester resin was measured using a differential scanning calorimeter (manufactured by SHIMADZU CORPORATION, "DSC-60") from the interaction of the baseline and the tangent to the endothermic curve in a chart at a temperature increasing rate of 5° C./min. As a measurement sample, in an aluminum pan, 10 mg±0.5 mg of a sample was measured, melted for 10 minutes at a temperature (100° C.) equal to or higher than the glass transition temperature, subjected to a rapid cooling treatment using dry ice, and then the resultant sample was used.

<Measurement of Softening Temperature (T4)>

Regarding a softening temperature of the polyester resin, a temperature when a ½ amount was flowed out of 1.0 g of a resin sample through a 1 mmϕ×10 mm nozzle under conditions of a load at 294 N and a programmed constant temperature increasing rate of 3° C./min was measured using a flow tester (manufactured by SHIMADZU CORPORATION, "CFT-500D"), and this temperature was regarded as a softening temperature.

<Measurement of Acid Value>

As acid value of the polyester resin was measured as fellows.

About 0.2 g of a measurement sample was accurately weighed in a branched Erlenmeyer flask (a (g)), 20 mL of benzyl alcohol was added and heat was applied to the measurement sample for 15 minutes by a heater set at 230° C. to melt the measurement sample under a nitrogen atmosphere. After the measurement sample was cooled to room temperature, 20 mL chloroform and a few drops of a cresol red solution were added. The acid value of the measurement sample was determined by using 0.02 N KOH solution (titration volume=b(mL), titer of KOH solution=p). A blank measurement was also conducted (titration volume=c (mL)), and the acid value was calculated according to the following equation.

$$\text{Acid value (mg KOH/g)}=\{(b-c)\times 0.02\times 56.11\times p\}/a$$

<Measurement of Mode Diameter>

The particle size distribution of the polyester resin was measured by using a laser diffraction particle size analyzer (manufactured by HORIBA, Ltd., "LA-920; "). According to the operation manual of the analyzer, a measurement flow cell was used, distilled water was added into the cell, the relative refractive index was selected and set to 1.20, the particle diameter basis was regarded as the volume basis, and adjustment of the optical axis, fine adjustment of the optical axis, and blank measurement were conducted. Then, an aqueous polyester dispersion was added until the concentration reached a range of transmittance 70 to 90%, an ultrasonic treatment was conducted at an intensity of 5 for 1 minute, and the particle size distribution measurement of the resin particles was conducted. From the measured particle size distribution, the particle diameter corresponding to a mode value (peak particle diameter) was regarded as a mode diameter.

TABLE 1

| Polyester resin (B) | | B-1 | B-2 | B-3 | B-4 | B-5 | B-6 |
|---|---|---|---|---|---|---|---|
| Polycarboxylic acid (parts by mole) | Terephthalic acid | 85 | 85 | 100 | 99 | 75 | 99 |
| | Isophthalic acid | 13 | 13 | 0 | 0 | 0 | 0 |
| | Trimellitic acid | 2 | 2 | 0 | 0 | 25 | 0 |
| | Adipic acid | 0 | 0 | 0 | 1 | 0 | 1 |
| Polyhydric alcohol (parts by mole) | Diol A | 35 | 35 | 50 | 35 | 75 | 25 |
| | Diol B | 1 | 1 | 40 | 0 | 0 | 0 |
| | Trimethylolpropane | 0 | 0 | 0 | 2 | 0 | 14 |
| | Ethylene glycol | 89 | 89 | 28 | 65 | 70 | 72 |

TABLE 1-continued

| Polyester resin (B) | | B-1 | B-2 | B-3 | B-4 | B-5 | B-6 |
|---|---|---|---|---|---|---|---|
| Wax (% by mass) | E-10J | 0 | 2 | 0 | 0 | 0 | 0 |
| | Amount of trivalent or higher carboxylic acid with respect to 100 parts by mole of acid component (parts by mole) | 2 | 2 | 0 | 0 | 25 | 0 |
| | Amount of trihydric or higher alcohol with respect to 100 parts by mole of acid component (parts by mole) | 0 | 0 | 0 | 2 | 0 | 14 |
| | Amount of bisphenol derivative with respect to 100 parts by mole of acid component (parts by mole) | 36 | 36 | 90 | 35 | 75 | 25 |
| Property | Glass transition temperature (° C.) | 54 | 52 | 60 | 58 | 58 | 60 |
| | Softening temperature (° C.) | 103 | 100 | 104 | 109 | 155 | 140 |
| | Acid value (mgKOH/g) | 10 | 11 | 7 | 19 | 5 | 7 |
| | Mode diameter (mm) | 2.1 | 2.0 | 1.8 | 2.3 | 2.2 | 2.6 |

Abbreviations in Table 1 are as follows.

Diol A: Propylene oxide derivative of bisphenol A (PO 2.3 mole adduct)

Diol B: Ethylene oxide derivative of bisphenol A (EO 2.3 mole adduct)

E-10J: Oxidized polyethylene wax (manufactured by Westlake Chemical Corporation, "epolene E-10J", acid value=16 to 18 mg KOH/g, mass average molecular weight=6,100, viscosity (CPS at 125° C.)=800 to 1,100)

[Master Batch for Toners (C)]

C-1 to C-8 were produced as follows.

The acrylic polymer (A) and the polyester resin (B) were mixed such that the mass ratio presented in Table 2 was obtained, thereby obtaining master batches for toners (C-1) to (C-8).

The mode diameters of the obtained master batches for toners (C-1) to (C-8) were measured in the similar manner to the polyester resin. The results thereof are presented in Table 2.

TABLE 2

| Master batch for toners (C) | Acrylic polymer (A) | Polyester resin (B) | Mass ratio (B/A) | Mode diameter (mm) |
|---|---|---|---|---|
| C-1 | A-1 | B-1 | 3 | 2.8 |
| C-2 | A-1 | B-1 | 5 | 2.5 |
| C-3 | A-1 | B-1 | 10 | 1.5 |
| C-4 | A-1 | B-1 | 2 | 2.8 |
| C-5 | A-2 | B-1 | 5 | 2.0 |
| C-6 | A-1 | B-1/B-2 = 50/50 (mass ratio) | 5 | 2.5 |
| C-7 | A-2 | B-1/B-2 = 50/50 (mass ratio) | 5 | 2.5 |
| C-8 | A-3 | B-1/B-2 = 50/50 (mass ratio) | 5 | 2.4 |

Examples 1, 2, 4, to 9, 11, 13, 14, 16, and 17 and Comparative Examples 1 and 4

<Toner Production 1>

The polyester resin (B) and the master batch for toners (C) were mixed according to the blending compositions presented in Tables 3 to 5 to obtain the mixture (D).

93 parts by mass of the obtained mixture (D), 3 parts by mass of quinacridone pigment (manufactured by Clariant, "E02") as a colorant, 1 part by mass of negative charge-type charge control agent (manufactured by Japan Cartlit Co., Ltd., "LR-147"), and 3 parts by mass of release agent (manufactured by TOYO ADL CORPORATION, "Polywax M-90") were mixed to form a powder mixture. Then, the powder mixture was melt-kneaded by using a twin-screw extruder (manufactured by Ikegai Corp., "PCM-29") for a staying time of 1 minute while respective cylinders were set to an external temperature such that Cylinder 1 was 20° C., Cylinder 2 was 60° C., Cylinder 3 was 100° C., and Cylinder 4 to the discharge die were 120° C., and then pulverized by a chopper mill (manufactured by Nippon Pneumatic Mfg. Co., Ltd.) to obtain a (powdery) toner passing through a 3 mm-sieve.

The glass transition temperature of the obtained toner was measured in the similar manner to the polyester resin, and the production stability and the high-temperature elasticity were evaluated as follows. The results thereof are presented in Tables 3 to 5.

Incidentally, regarding Example 16, a toner was produced in the similar manner to Toner Production 3 to be described later, and the material dispersibility of the obtained toner was also evaluated. The results thereof are presented in Table 4.

<Evaluation>

(Evaluation of Production Stability)

After 3 minutes from the start of melting and kneading, 10 g of the kneaded product was collected and used as a resin sample. The collected resin sample was pulverized by a trio blender. A temperature when 4 mm of the pulverized piece was flowed out of 1.0 g of a resin sample through a 1 mmϕ×10 mm nozzle under conditions of a load at 294 N and a programmed constant temperature increasing rate of 3° C./min was measured using a SHIMADZU flow tester (manufactured by SHIMADZU CORPORATION, "CFT-500D"), and this temperature was regarded as a softening temperature (T4).

Also, after 10 minutes from the start of melting and kneading, similarly, 10 g of the kneaded product was collected, the softening temperature (T4) was measured, and the production stability was evaluated according to the following evaluation criteria.

○ (good) A difference between the softening temperature (T4) after 3 minutes from the start and the softening temperature (T4) after 10 minutes is lower than 2° C.

Δ (usable) A difference between the softening temperature (T4) after 3 minutes from the start and the softening temperature (T4) after 10 minutes is 2° C. or higher and 3° C. or lower.

× (poor) A difference between the softening temperature (T4) after 3 minutes from the start and the softening temperature (T4) after 10 minutes is higher than 3° C.

(Evaluation of High-Temperature Elasticity)

The storage elastic modulus (G') of the toner was measured by using a rotating type rheometer (manufactured by TA Instruments, "AR-2000ex"). The measurement conditions are as follows.

Geometry: 25 mmϕ parallel plate

GAP: 1 mm

Frequency: 1 Hz

Strain: 0.01

Measurement temperature: 80 to 240° C. (increasing at 3° C./min)

The storage elastic modulus (G') shows a good correlation with the hot offset resistance of the toner. The high-temperature elasticity was evaluated according to the following evaluation criteria from the storage elastic modulus (G') at 200° C.

○ (good):The storage elastic modulus (G') is 200 Pa or more and 10,000 Pa or less.

× (poor): The storage elastic modulus (G') is less than 200 Pa or more than 10,000 Pa.

Examples 3, 10, 12, 15, 16, and 18

<Toner Production 2>

A toner was produced in the similar manner to Toner Production 1 described above, except that the blending compositions were changed as presented in Tables 3 and 4, and the production stability of the obtained toner was evaluated. Further, the glass transition temperature of the collected kneaded product at the time of the evaluation of the production stability was measured in the similar manner to the polyester resin. The results thereof are presented in Tables 3 and 4.

<Toner Production 3>

The polyester resin (B) and the master hatch for toners (C) were mixed according to the blending compositions presented in Tables 3 and 4 to obtain the mixture (D).

95 parts by mass of the obtained mixture (D) and 5 parts by mass of release agent (manufactured by TOYO ADL CORPORATION, "Polywax M-90") were mixed to form a powder mixture. Then, the powder mixture was melt-kneaded by using a twin-screw extruder (manufactured by Ikegai Corp., "PCM-29") for a staying time of 1 minute while respective cylinders were set to an external temperature such that Cylinder 1 was 20° C., Cylinder 2 was 60° C., Cylinder 3 was 100° C., and Cylinder 4 to the discharge die were 120° C., and then pulverized by a chopper mill (manufactured by Nippon Pneumatic Mfg. Co., Ltd.) to obtain a (powdery) toner passing through a 3 mm-sieve.

The material dispersibility of the obtained toner was evaluated as follows. The results thereof are presented in Tables 3 and 4.

(Evaluation of Material Dispersibility)

The particle diameter of the wax in the toner was observed with an optical microscope (magnification: 400), the particle diameters of 10 particles of the wax were measured in an arbitrary field of view to calculate a number average particle diameter, and then the material dispersibility was evaluated according to the following evaluation criteria.

○ (good) The number average particle diameter of the wax is 1 μm or less.

Δ (usable): The number average particle diameter of the wax is more than 1 μm and 5 μm or less.

× (poor) The number average particle diameter of the wax is more than 5 μm.

Comparative Example 2

0.4% by mass of the acrylic polymer (A-1) and 99.6% by mass of the polyester resin (B-1) were mixed to obtain the mixture (D).

A toner was produced in the similar manner to Toner Production 1 described above, except that the obtained mixture (D) was used, and production stability and high-temperature elasticity were evaluated. The results thereof are presented in Table 5.

Comparative Example 3

0.4% by mass of the acrylic polymer (A-2) and 99.6% by mass of the polyester resin (B-1) were mixed to obtain the mixture (D).

A toner was produced in the similar manner to Toner Production 1 described above, except that the obtained mixture (D) was used, and production stability was evaluated. The glass transition temperature of the collected kneaded product at the time of the evaluation of the production stability was measured in the similar manner to the polyester resin. The results thereof are presented in Table 5.

Further, a toner was produced in the similar manner to Toner Production 3 described above, except that the obtained mixture (D) was used, and material dispersibility was evaluated. The results thereof are presented in Table 5.

Comparative Example 5

0.2% by mass of the acrylic polymer (A-1) and 99.8% by mass of the polyester resin (B-1) were mixed to obtain the mixture (D).

A toner was produced in the similar manner to Toner Production 1 described above, except that the obtained mixture (D) was used, and production stability and high-temperature elasticity were evaluated. The results thereof are presented in Table 5.

TABLE 3

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Acrylic polymer (A) | A-1 | 0 | 0 | 0 | 0 | 0 | 0 | 0 | 0 | 0 | 0 |
| (% by mass) | A-2 | 0 | 0 | 0 | 0 | 0 | 0 | 0 | 0 | 0 | 0 |
| Polyester resin (B) | B-1 | 98 | 98 | 98 | 98 | 0 | 0 | 0 | 48 | 48 | 48 |
| (% by mass) | B-2 | 0 | 0 | 0 | 0 | 98 | 0 | 0 | 0 | 0 | 0 |
| | B-3 | 0 | 0 | 0 | 0 | 0 | 98 | 0 | 0 | 0 | 0 |
| | B-4 | 0 | 0 | 0 | 0 | 0 | 0 | 98 | 0 | 0 | 0 |
| | B-5 | 0 | 0 | 0 | 0 | 0 | 0 | 0 | 50 | 0 | 0 |
| | B-6 | 0 | 0 | 0 | 0 | 0 | 0 | 0 | 0 | 50 | 50 |

TABLE 3-continued

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Master batch for toners (C) (% by mass) | C-1 | 2 | 0 | 0 | 0 | 0 | 0 | 0 | 0 | 0 | 0 |
| | C-2 | 0 | 2 | 0 | 0 | 2 | 2 | 2 | 2 | 2 | 0 |
| | C-3 | 0 | 0 | 0 | 2 | 0 | 0 | 0 | 0 | 0 | 0 |
| | C-4 | 0 | 0 | 0 | 0 | 0 | 0 | 0 | 0 | 0 | 0 |
| | C-5 | 0 | 0 | 2 | 0 | 0 | 0 | 0 | 0 | 0 | 2 |
| | C-6 | 0 | 0 | 0 | 0 | 0 | 0 | 0 | 0 | 0 | 0 |
| | C-7 | 0 | 0 | 0 | 0 | 0 | 0 | 0 | 0 | 0 | 0 |
| | C-8 | 0 | 0 | 0 | 0 | 0 | 0 | 0 | 0 | 0 | 0 |
| Proportion of acrylic polymer (A) (% by mass) | | 0.50 | 0.33 | 0.33 | 0.18 | 0.33 | 0.33 | 0.33 | 0.33 | 0.33 | 0.33 |
| Glass transition temperature of toner (° C.) | | 55 | 54 | — | 53 | 52 | 61 | 62 | 58 | 59 | — |
| Glass transition temperature of kneaded product (° C.) | | — | — | 53 | — | — | — | — | — | — | 57 |
| Production stability | Difference of T4 (° C.) | 1.1 | 0.8 | 0.8 | 0.5 | 0.9 | 0.5 | 1.9 | 1.6 | 1.8 | 0.7 |
| | Evaluation | ○ | ○ | ○ | ○ | ○ | ○ | ○ | ○ | ○ | ○ |
| High-temperature elasticity | Storage elastic modulus (Pa) | 800 | 520 | — | 280 | 550 | 180 | 670 | 5500 | 3200 | — |
| | Evaluation | ○ | ○ | — | ○ | ○ | ○ | ○ | ○ | ○ | — |
| Material dispersibility | Number average particle diameter (μm) | — | — | ≤1 | — | — | — | — | — | — | ≤1 |
| | Evaluation | — | — | ○ | — | — | — | — | — | — | ○ |

TABLE 4

| | | Example 11 | Example 12 | Example 13 | Example 14 | Example 15 | Example 16 | Example 17 | Example 18 |
|---|---|---|---|---|---|---|---|---|---|
| Acrylic polymer (A) (% by mass) | A-1 | 0 | 0 | 0 | 0 | 0 | 0 | 0 | 0 |
| | A-2 | 0 | 0 | 0 | 0 | 0 | 0 | 0 | 0 |
| Polyester resin (B) (% by mass) | B-1 | 48 | 48 | 90 | 85 | 90 | 98 | 0 | 98 |
| | B-2 | 0 | 0 | 0 | 0 | 0 | 0 | 0 | 0 |
| | B-3 | 0 | 0 | 0 | 0 | 0 | 0 | 0 | 0 |
| | B-4 | 0 | 0 | 0 | 0 | 0 | 0 | 85 | 0 |
| | B-5 | 0 | 0 | 0 | 0 | 0 | 0 | 0 | 0 |
| | B-6 | 50 | 50 | 0 | 0 | 0 | 0 | 0 | 0 |
| Master batch for toners (C) (% by mass) | C-1 | 0 | 0 | 0 | 0 | 0 | 0 | 15 | 0 |
| | C-2 | 0 | 0 | 10 | 15 | 0 | 1 | 0 | 0 |
| | C-3 | 0 | 0 | 0 | 0 | 0 | 0 | 0 | 0 |
| | C-4 | 0 | 0 | 0 | 0 | 0 | 0 | 0 | 0 |
| | C-5 | 0 | 0 | 0 | 0 | 10 | 1 | 0 | 0 |
| | C-6 | 2 | 0 | 0 | 0 | 0 | 0 | 0 | 0 |
| | C-7 | 0 | 2 | 0 | 0 | 0 | 0 | 0 | 0 |
| | C-8 | 0 | 0 | 0 | 0 | 0 | 0 | 0 | 2 |
| Proportion of acrylic polymer (A) (% by mass) | | 0.33 | 0.33 | 1.67 | 2.50 | 1.67 | 0.33 | 3.75 | 0.33 |
| Glass transition temperature of toner (° C.) | | 57 | — | 54 | 55 | — | 54 | 64 | — |
| Glass transition temperature of kneaded product (° C.) | | — | 57 | — | — | 52 | 53 | — | 53 |
| Production stability | Difference of T4 (° C.) | 0.9 | 1.2 | 1.3 | 1.9 | 1.8 | 0.5 | 2.5 | 0.7 |
| | Evaluation | ○ | ○ | ○ | ○ | ○ | ○ | Δ | ○ |
| High-temperature elasticity | Storage elastic modulus (Pa) | 850 | — | 1850 | 3000 | — | 280 | 8900 | — |
| | Evaluation | ○ | — | ○ | ○ | — | ○ | ○ | — |
| Material dispersibility | Number average particle diameter (μm) | — | ≤1 | — | — | ≤1 | 1.8 | — | ≤1 |
| | Evaluation | — | ○ | — | — | ○ | Δ | — | ○ |

TABLE 5

| | | Comparative Example 1 | Comparative Example 2 | Comparative Example 3 | Comparative Example 4 | Comparative Example 5 |
|---|---|---|---|---|---|---|
| Acrylic polymer (A) (% by mass) | A-1 | 0 | 0.4 | 0 | 0 | 0.2 |
| | A-2 | 0 | 0 | 0.4 | 0 | 0 |
| Polyester resin (B) (% by mass) | B-1 | 98 | 99.6 | 99.6 | 0 | 99.8 |
| | B-2 | 0 | 0 | 0 | 0 | 0 |

TABLE 5-continued

| | | Comparative Example 1 | Comparative Example 2 | Comparative Example 3 | Comparative Example 4 | Comparative Example 5 |
|---|---|---|---|---|---|---|
| | B-3 | 0 | 0 | 0 | 0 | 0 |
| | B-4 | 0 | 0 | 0 | 75 | 0 |
| | B-5 | 0 | 0 | 0 | 0 | 0 |
| | B-6 | 0 | 0 | 0 | 0 | 0 |
| Master batch for toners (C) (% by mass) | C-1 | 0 | 0 | 0 | 25 | 0 |
| | C-2 | 0 | 0 | 0 | 0 | 0 |
| | C-3 | 0 | 0 | 0 | 0 | 0 |
| | C-4 | 2 | 0 | 0 | 0 | 0 |
| | C-5 | 0 | 0 | 0 | 0 | 0 |
| | C-6 | 0 | 0 | 0 | 0 | 0 |
| | C-7 | 0 | 0 | 0 | 0 | 0 |
| | C-8 | 0 | 0 | 0 | 0 | 0 |
| Proportion of acrylic polymer (A) (% by mass) | | 0.67 | 0.40 | 0.40 | 6.25 | 0.20 |
| Glass transition temperature of toner (° C.) | | 58 | — | — | 68 | — |
| Glass transition temperature of kneaded product (° C.) | | — | — | 53 | — | — |
| Production stability | Difference of T4 (° C.) | 2.9 | 4.5 | 3.1 | 7.3 | 2.8 |
| | Evaluation | Δ | X | X | X | Δ |
| High-temperature elasticity | Storage elastic modulus (Pa) | 12800 | Unmeasurable | — | 28050 | Unmeasurable |
| | Evaluation | X | X | — | X | X |
| Material dispersibility | Number average particle diameter (μm) | — | — | ≥5 | — | — |
| | Evaluation | — | — | X | — | — |

In Tables 3 to 5, "the proportion of the acrylic polymer (A)" is a ratio (% by mass) of the acrylic polymer (A) to the total mass of the acrylic polymer (A) and the polyester resin (B).

As clearly understood from the results of Tables 3 and 4, the toners obtained in Examples 1 to 18 were excellent in production stability.

In particular, the toners of Examples 1, 2, 4, to 9, 11, 13, 14, 16, and 17 using the polymer having a glycidyl (meth) acrylate unit as the acrylic polymer (A) were also excellent in high-temperature elasticity. Further, the toners of Examples 3, 10, 12, 15, 16, and 18 using the polymer having a methyl methacrylate unit, a n-butyl methacrylate unit, and a n-butyl acrylate unit or the polymer having a methyl methacrylate unit and an isobtuyl methacrylate unit as the acrylic polymer (A) were also excellent in dispersibility of the wax (release agent).

On the other hand, as clearly understood from the results of Table 5, the toner of Comparative Example 1 using the master batch for toners (C) in which the mass ratio of the polyester resin (B1) and the acrylic polymer (A) is less than 2.5 was inferior to each Example in production stability. For this reason, in Comparative Example 1, the polymer having a glycidyl (meth)acrylate unit was used as the acrylic polymer (A), but the effect of the acrylic polymer (A) was not obtained and the toner of Comparative Example 1 was also inferior in high-temperature elasticity.

In the case of Comparative Examples 2, 3, and 5 in which the toner was produced by mixing the acrylic polymer (A) and the polyester resin (B) without use of the master batch for toners (C), the toners of Comparative Examples 2, 3, and 5 were further inferior to the toner of Comparative Example 1 in production stability. For this reason, the effect of the acrylic polymer (A) was not obtained, the toners of Comparative Examples 2 and 5 were inferior in high-temperature elasticity, and the toner of Comparative Example 3 was interior in material dispersibility.

The toner obtained in Comparative Example 4 in which the content of the acrylic polymer (A) is more than 5% by mass with respect to the total mass of the master batch for toners (C) and the polyester resin (B2) was inferior in production stability and high-temperature elasticity.

INDUSTRIAL APPLICABILITY

By using the master batch for toners of the invention, a toner with less variation in toner performance can be stably produced. Further, the toner of the invention has less variation in toner performance.

The toner of the invention can be used as any developer of a magnetic one-component developer, a non-magnetic one-component developer, and a two-component developer, and is useful.

The invention claimed is:

1. A master batch for toners, the master batch comprising:

an acrylic polymer (A) having an average particle diameter of 0.01 to 500 μm; and a polyester resin (B1) having a mode diameter of 0.3 to 5 mm, wherein a mass ratio represented by the polyester resin (B1) the acrylic polymer (A) is 2.5 or more.

2. The master batch for toners according to claim 1, wherein the acrylic polymer (A) is a polymer having two or more units selected from the group consisting of a methyl methacrylate unit, an n-butyl methaciylate unit, an n-butyl acrylate unit, and an isobutyl methacrylate unit.

3. The master batch for toners according to claim 1, wherein the acrylic polymer (A) is a polymer having a glycidyl (meth)acrylate unit.

4. A toner, comprising the master batch of claim 1 and a polyester resin (B2), wherein a content of the acrylic polymer (A) with respect to a total mass of the master batch and the polyester resin (B2) is 5% by mass or less.

5. The toner according to claim 4, wherein:

the polyester resin (B1) and the polyester (B2) are reaction products of an acid component and an alcohol component; and a proportion of a bisphenol derivative in the polyester resin (B1) and in the polyester resin (B2), with respect to 100 parts by mole of the acid component, is 60 parts by mole or less.

6. The toner according to claim 4, wherein a storage elastic modulus (G') of the toner at 200° C. is 200 to 10,000 Pa.

7. The toner according to claim 4, wherein the acrylic polymer (A) is a polymer having two or more units selected from the group consisting of a methyl methacrylate unit, an n-butyl methacrylate unit, an n-butyl acrylate unit, and an isobutyl methacrylate unit.

8. The toner according to claim 4, wherein the acrylic polymer (A) is a polymer having a glycidyl (meth)acrylate unit.

9. The toner according to claim 4, wherein the toner comprises two or more polyester resins each having a different softening temperature.

10. The toner according to claim 4, wherein:

the polyester resin (B1) and the polyester (B2) are reaction products of an acid component and an alcohol components;

a proportion of trivalent or higher carboxylic acid in the polyester resin (B1) and in the polyester (B2), with respect to 100 parts by mole of the acid component, is 25 parts by mole or less; and a proportion of trihydric or higher alcohol in the polyester resin (B1) and in the polyester resin (B2) is 20 parts by mole or less.

11. The master batch for toners according to claim 1, wherein:

the polyester resin (B1) is a reaction product of an acid component and an alcohol component; and a proportion of a bisphenol derivative in the polyester resin (B1), with respect to 100 parts by mole of the acid component, is 60 parts by mole or less.

12. The master hatch for toners according to claim 1, wherein:

the polyester resin (B1) is a reaction product of an acid component and an alcohol component;

a proportion of trivalent or higher carboxylic acid in the polyester resin (B1), with respect to 100 parts by mole of the acid component, is 25 parts by mole or less; and a proportion of trihydric or higher alcohol in the polyester resin (B1) is 20 parts by mole or less.

13. A method for producing a master batch for toners, the method comprising mixing an acrylic polymer (A) having an average particle diameter of 0.01 to 500 μm and a polyester resin (B1) having a mode diameter of 0.3 to 5 mm such that a mass ratio represented by the polyester resin (B1)/the acrylic polymer (A) is 2.5 or more.

14. The method according to claim 13, wherein the polyester resin (B1) comprises two or more polyester resins each having a different softening temperature.

15. A method for producing a toner, the method comprising mixing a master batch comprising aa mixture of an acrylic polymer (A) having an average particle diameter of 0.01 to 500 μm and a polyester resin (B1) having a mode diameter of 0.3 to 5 mm, and in which a mass ratio represented by the polyester resin (B1)/the acrylic polymer (A) is 2.5 or more and a polyester resin (B2), such that a content of the acrylic polymer (A) with respect to a total mass of the master batch and the polyester resin (B2) is 5% by mass or less.

16. The method according to claim 15, wherein the polyester resin (B1) comprises two or more polyester resins each having a different softening temperature.

17. A toner obtained by mixing a master batch, comprising a mixture of an acrylic polymer (A) having an average particle diameter of 0.01 to 500 μm and a polyester resin (B1) having a mode diameter of 0.3 to 5 mm, and in which a mass ratio represented by the polyester resin (B1)/the acrylic polymer (A) is 2,5 or more, and a polyester resin (B2), such that a content of the acrylic polymer (A) with respect to a total mass of the master batch and the polyester resin (B2) is 5% by mass or less.

* * * * *